US006085446A

United States Patent [19]

Posch

[11] Patent Number: 6,085,446

[45] Date of Patent: Jul. 11, 2000

[54] DEVICE FOR EXCAVATING AN ELONGATED DEPRESSION IN SOIL

[76] Inventor: Jürgen Posch, Kuhnbergstrasse 23, 73037 Göppingen, Germany

[21] Appl. No.: 09/208,810

[22] Filed: Dec. 9, 1998

[30] Foreign Application Priority Data

Dec. 9, 1997 [DE] Germany ..... 197 54 399

[51] Int. Cl.[7] ..... E02F 3/28; E02F 3/78

[52] U.S. Cl. ..... 37/343; 37/352; 37/403; 37/410; 37/189

[58] Field of Search ..... 37/357, 352, 408, 37/409, 410, 189, 903, 464, 403, 347, 343, 342, 324, 328; 299/39.4, 85.1, 80.1

[56] References Cited

U.S. PATENT DOCUMENTS

| | | |
|---|---|---|
| 2,665,655 | 1/1954 | Brown et al. . |
| 3,000,620 | 9/1961 | Densmore . |
| 3,148,917 | 9/1964 | Thompson . |
| 3,341,254 | 9/1967 | Arndt . |
| 3,477,762 | 11/1969 | Frenyo et al. . |
| 4,100,688 | 7/1978 | Grist . |
| 5,592,761 | 1/1997 | Ward . |

FOREIGN PATENT DOCUMENTS

| | | |
|---|---|---|
| 24221 | 9/1984 | Austria . |
| 0253726 | 1/1988 | European Pat. Off. . |
| 0496926 | 8/1992 | European Pat. Off. . |
| 960592 | 10/1953 | Germany . |
| 960392 | 2/1954 | Germany . |
| 1756180 | 3/1970 | Germany . |
| 3603675 | 7/1986 | Germany . |
| 8704177 | 8/1988 | Germany . |
| 9118152 | 11/1991 | WIPO . |

*Primary Examiner*—H. Shackelford
*Attorney, Agent, or Firm*—Robert W. Becker & Associates

[57] ABSTRACT

An excavating device has conical milling tools each having a longitudinal center axis. At least one motor is provided for rotatingly driving the milling tools about their longitudinal center axis. The milling tools each have a mantle surface. The mantle surfaces are positioned at one circumferential point adjacent to one another at a minimum spacing defining a working play between the milling tools such that the mantle surfaces form a continuous working plane. The longitudinal center axis of the milling tools are positioned angularly to one another and to a vertical axis extending between the milling tools. Each longitudinal center axis is positioned at an angle of between 50° and 70° to the vertical axis. Each one of the longitudinal center axes is positioned at an angle of less than 90° relative to the advancing direction of the excavating device.

12 Claims, 5 Drawing Sheets

DEVICE FOR EXCAVATING AN ELONGATED DEPRESSION IN SOIL

BACKGROUND OF THE INVENTION

The present invention relates to a device for excavating an elongate depression in soil, especially for excavating a ditch, wherein the device comprises at least one motor for driving milling tools which are substantially in the shape of a cone or frusto-cone and are supported so as to be driven in rotation about their longitudinal axis. The longitudinal axes of the milling tools extend at an angle to one another, and the mantle surfaces of the milling tools are positioned at one location of their circumference with a minimal spacing to one another that provides a working play. The thus arranged milling tools provide a continuous working plane.

For excavating a ditch, for example, for the purpose of laying pipelines in the soil, it is conventional to employ excavators depending on the desired width of the ditch, have a correspondingly wide excavator shovel. Depending on the type of soil, it is expedient to first loosen the soil so that the excavator shovel can easily remove the soil. Known ditch milling devices have, in general two, driven milling tools which extend laterally from a central support and are driven in rotation about their longitudinal axis. This construction requires a stay of the support to be positioned between the milling tools so that during milling a strip of soil will not be loosened which corresponds to the stay between the milling tools. Thus, a nonuniform milling result will be obtained. For removing the strip of soil that remains at the center, the milling device is then moved back and forth in a direction transverse to the longitudinal direction of the ditch which results in the ditch being made wider than is actually necessary. This back and forth movement results in an increased loading of the excavator due to transverse forces which act on the support of the excavator arm.

In European patent application 0 253 726 a device for excavating an elongate depression in the soil, especially for excavating a ditch, is known which comprises semi drums driven by a motor which are provided at their circumference with tools. The semi-drums are supported on a vertical stay which is positioned between the semi-drums. The rotational axis of the semi-drums are slightly slanted in a downward direction. As a drive a hydraulic motor is used.

It is an object of the present invention to provide a device of the aforementioned kind which is optimized with respect to the revolving masses of the milling tools and which during operation is directionally stable.

SUMMARY OF THE INVENTION

According to the present invention, the longitudinal center axes of the milling tools are positioned at an angle of approximately 50°–70° to a vertical axes and the longitudinal axis of the milling tools, relative to the advancing direction of the excavating device in the ditch, have an angle of less than 90° to the advancing direction.

The advantage of the present invention is that for the milling process the rotating milling tools are to be moved exclusively in the longitudinal direction within the soil and no transverse movement is required. The slant of the longitudinal center axes of the milling tools is such that each longitudinal center axis has an angle of approximately 50°–70° to the vertical axis. The milling tools have substantially a cone structure or a frusto-conical structure, whereby in the following the term cone and conical are meant to include both the cone structure as well as a frusto-conical structure. The angle of the mantle surfaces of the conical structure, relative to the cone base, corresponds to the angle that the longitudinal axis of the milling tools have to the vertical axis. Because of the slanted arrangement of the longitudinal axis of the milling tools the mantle surfaces thus provide only at one location of their circumference a continuous working plane whereby this continuous working plane is downwardly oriented, i.e., faces the bottom of the ditch to be excavated. Accordingly, the milling process can be performed in a simple manner and only that amount soil is acted on that corresponds to the desired width or dimension of the ditch to be excavated.

The angles of both longitudinal axes are preferably identical so that the vertical axis provides a symmetry axis for the entire device. Especially preferred is an angle of 60° of each longitudinal center axis to the vertical axis.

Since the longitudinal center axis of the milling tools, relative to the longitudinal advancing direction of the device in the ditch to be excavated, has an angle of less than 90° and the angles of both longitudinal center axes are identical, a wedge shape of the removal surfaces and thus a directional stabilization is achieved in the longitudinal advancing direction. The wedge shape, on the other hand, can also be provided by the mantel surfaces of the milling tools, i.e., the mantle surfaces of the conical structures at their forward side in the advancing direction have an angle of less than 180°, preferably between 150° and 160°. Since the free ends of the conical structures in the advancing direction project somewhat relative to the cone base, a self centering action of the milling device results which also provides for directional stability.

As a drive motor for the milling tools a hydraulic motor is especially suitable. Preferably, each one of the milling tools has a separate hydraulic motor, whereby the milling tool is preferably directly placed onto the shaft of the hydraulic motor. In order to provide a space-saving construction, the milling tool is provided at its cone base with a recess whereby the mantle portion of the cone surrounding the recess receives at least partly the hydraulic motor. This also provides a protection of the hydraulic motor within the cone structure.

The motor, preferably hydraulic motor, and the two milling tools together with a support form a constructive unit that can be fastened as an attachment to an excavating machine, preferably an excavator. In this manner, the inventive device can be employed with different types of excavating machines, depending on their availability. For fastening to an excavator, it is expedient to attach the attachment to the back side of an excavator shovel. With such an arrangement it is possible to save costs because the conventionally required tool readying time for removing one tool and attaching another is no longer required. Due to the arrangement of the milling device at the back side of the excavator shovel, the device does not impede the action of the excavator shovel, but, on the other hand, the weight of the excavator shovel, when the milling tool is used, positively affects a vertical movement.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1–6.

Figure 1:
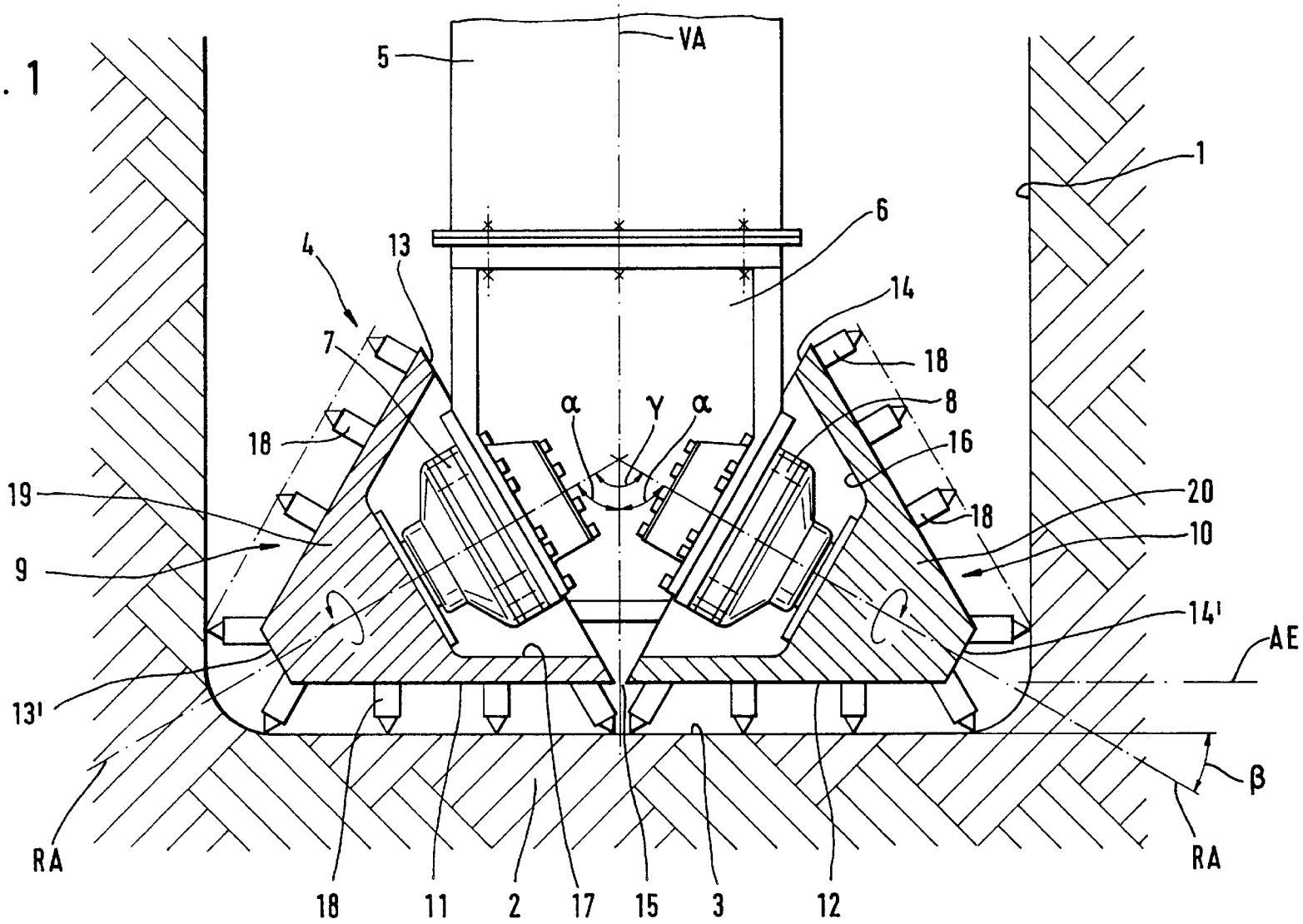
FIG. 1 shows a section of a ditch with the inventive milling device arranged therein.

In FIG. 1, a ditch 1 in soil 2 is represented whereby the ditch 1 is substantially of a rectangular cross-section with a planar bottom 3. An inventive milling device 4 is positioned in the ditch 1 which is connected to the moveable arm 5 of an excavator and is lowered into the soil, respectively, is moved in the advancing direction.

The milling device 4 comprises hydraulic motors 7, 8 connected to a support 6, whereby on the motor shafts of the motors 7, 8 a respective milling tool 9, 10 is fastened. The milling tools 9 and 10 have a frusto-conical structure 19, 20 which is arranged centrally on the shaft of the hydraulic motors 7, 8 so that a longitudinal center axis RA of the frusto-conical structure 19, 20 provides the axis of rotation of the milling tools 9, 10.

As can be seen in FIG. 1, the longitudinal axes RA are positioned relative to a vertical axis VA at an angle $\alpha$ of 60° so that an angle $\beta$ of the longitudinal center axis RA relative to the bottom 3 of the ditch 1 is 30°. The angle $\gamma$ defined between the longitudinal axis RA is 120°. The mantle surfaces 11, 12 of the frusto-conical structure 19, 20 are provided with a plurality of milling blades 18. Due to the extension of the longitudinal axis RA at a slant to the bottom 3, the frusto-conical structure 19, 20 of the millings tools 9, 10 are arranged such that their mantle surfaces 11, 12 extend parallel to the bottom 3. The mantle surfaces 11 and 12 of the milling tools 9 and 10 are positioned with their respective cone bases 13, 14 at their sides adjacent to the bottom 3 at a spacing corresponding to a working play 15 such to one another that a continuous working plane AE parallel to the bottom 3 results.

In order for the frusto-conical structures 19, 20 to be positioned closely adjacent to one another with their mantle surfaces 11, 12 at the bases 13, 14 and to thus provide a compact design, the frusto-conical structures 19, 20 are provided at their bases 13, 14 with a respective recess 16, 17 in which the hydraulic motors 7, 8 are at least partly received so that the mantle surfaces 11, 12 of the structures 19, 20 at least partly cover the hydraulic motors 7, 8. The frusto-conical structures 19, 20 have top sides 13' and 14' oriented toward the respective side portion of the ditch 1.

Figure 2:
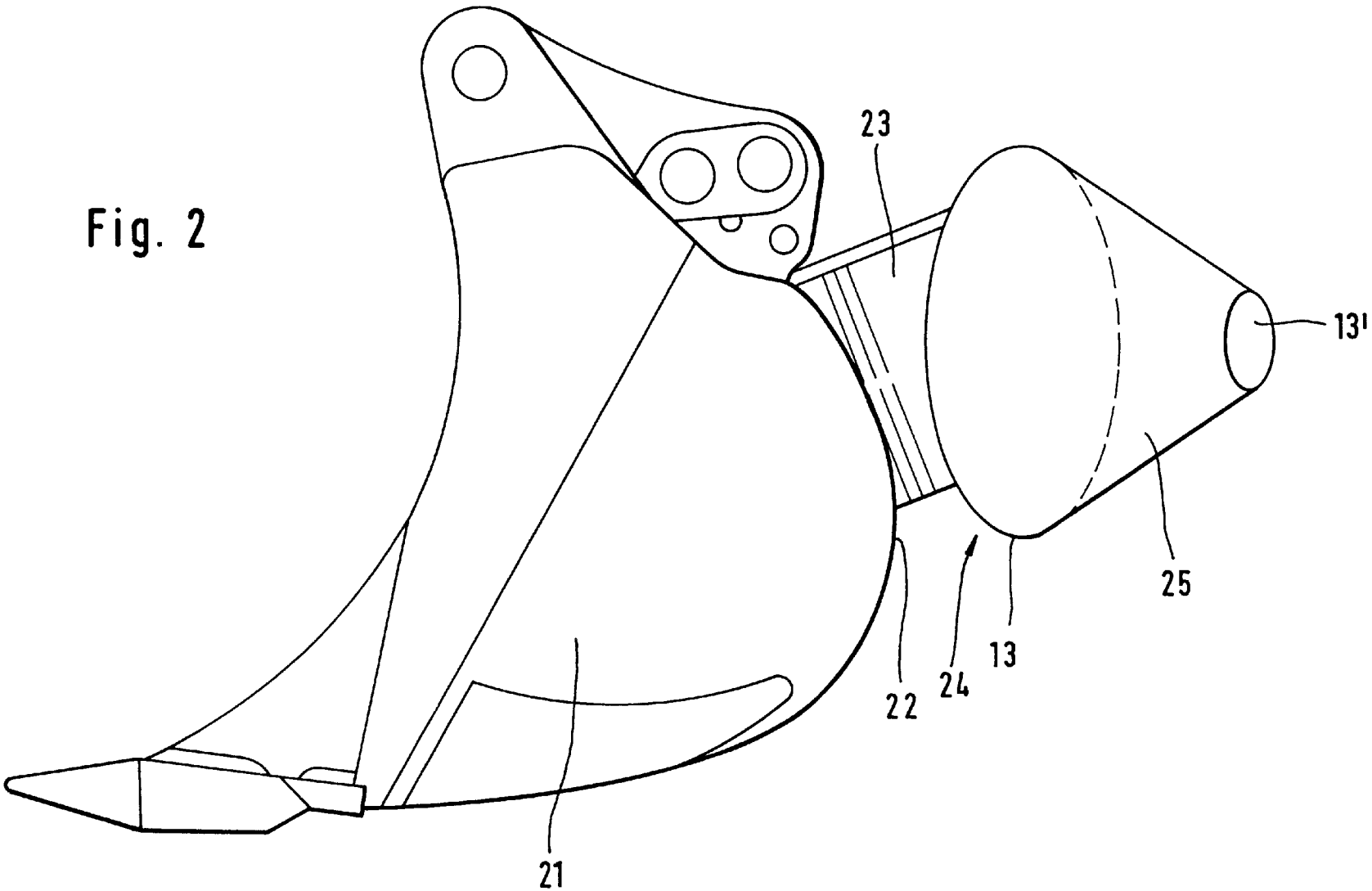
FIG. 2 shows a combined milling and shovel device.

In FIG. 2, a side view of an excavator shovel 21 is represented having at its back side 22 a milling device 24. The milling device 24 comprises a support 23 for non-represented hydraulic motors and milling tools. Only one milling tool 25 is represented in the side view. Due to the slanted arrangement of the longitudinal center axis RA to the vertical axis VA in the ditch 1 as shown in FIG. 1, in the representation of FIG. 2 the top side 13' of the frusto-conical structure 19, relative to the cone base 13 of the milling tool 25, is arranged off-center so that the working plane AE according to FIG. 1 is positioned parallel to the bottom 3.

Figure 3:
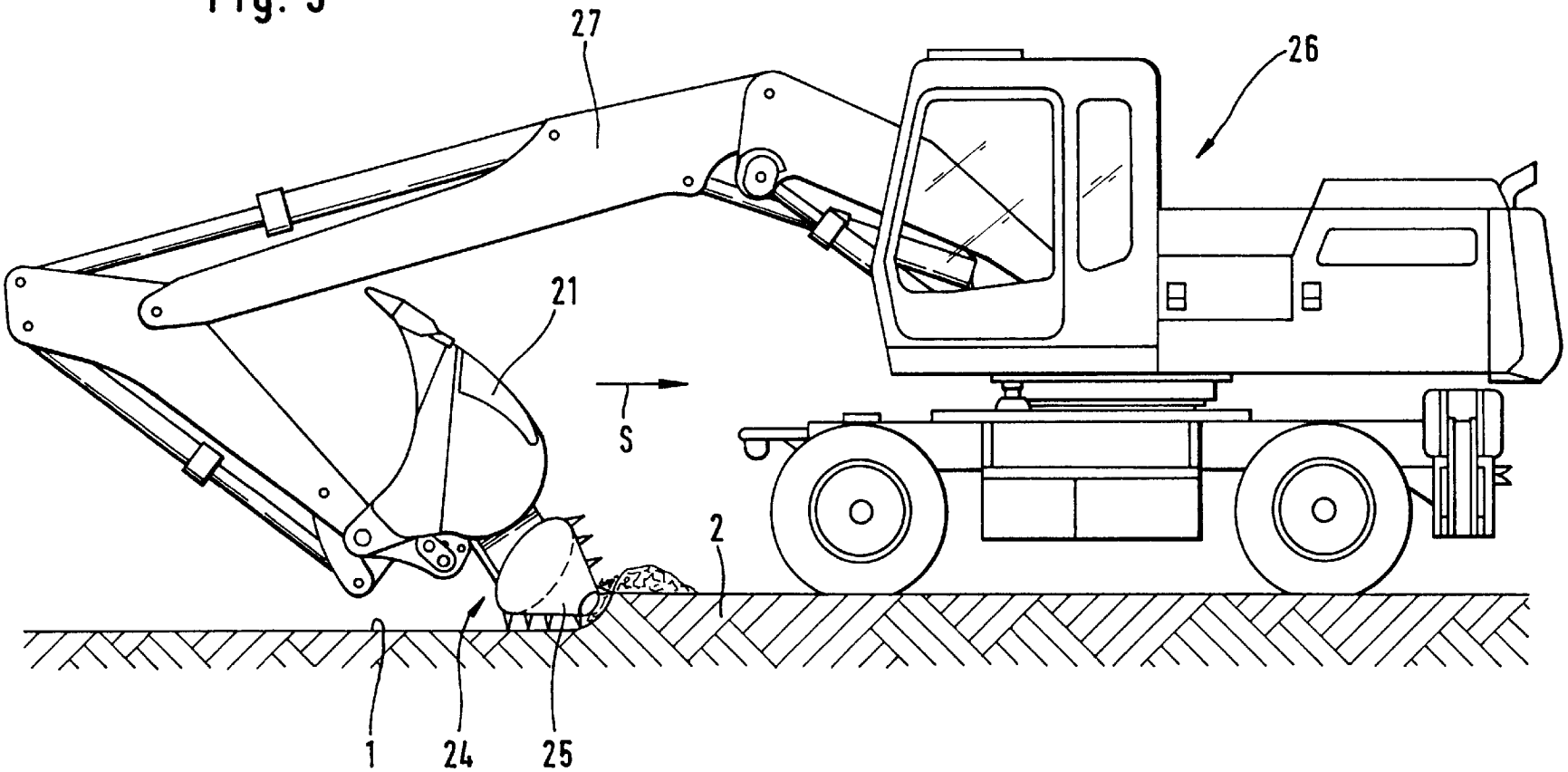
FIG. 3 shows an excavator with excavator shovel and milling device during milling excavation.

FIG. 3 shows an excavator 26 having an arm 27 with a combined excavation device comprising an excavator shovel 21 and a milling device 24. When the excavator shovel 21 is folded inwardly, the milling tools 25 point toward the soil 2 so that the ditch 1 can be milled. The milling tools 25 thus loosen the soil 2 in the width desired for the ditch, whereby however removal of the soil from the ditch is not possible with the milling device 24. The advancing direction is indicated with arrow S.

Figure 4:
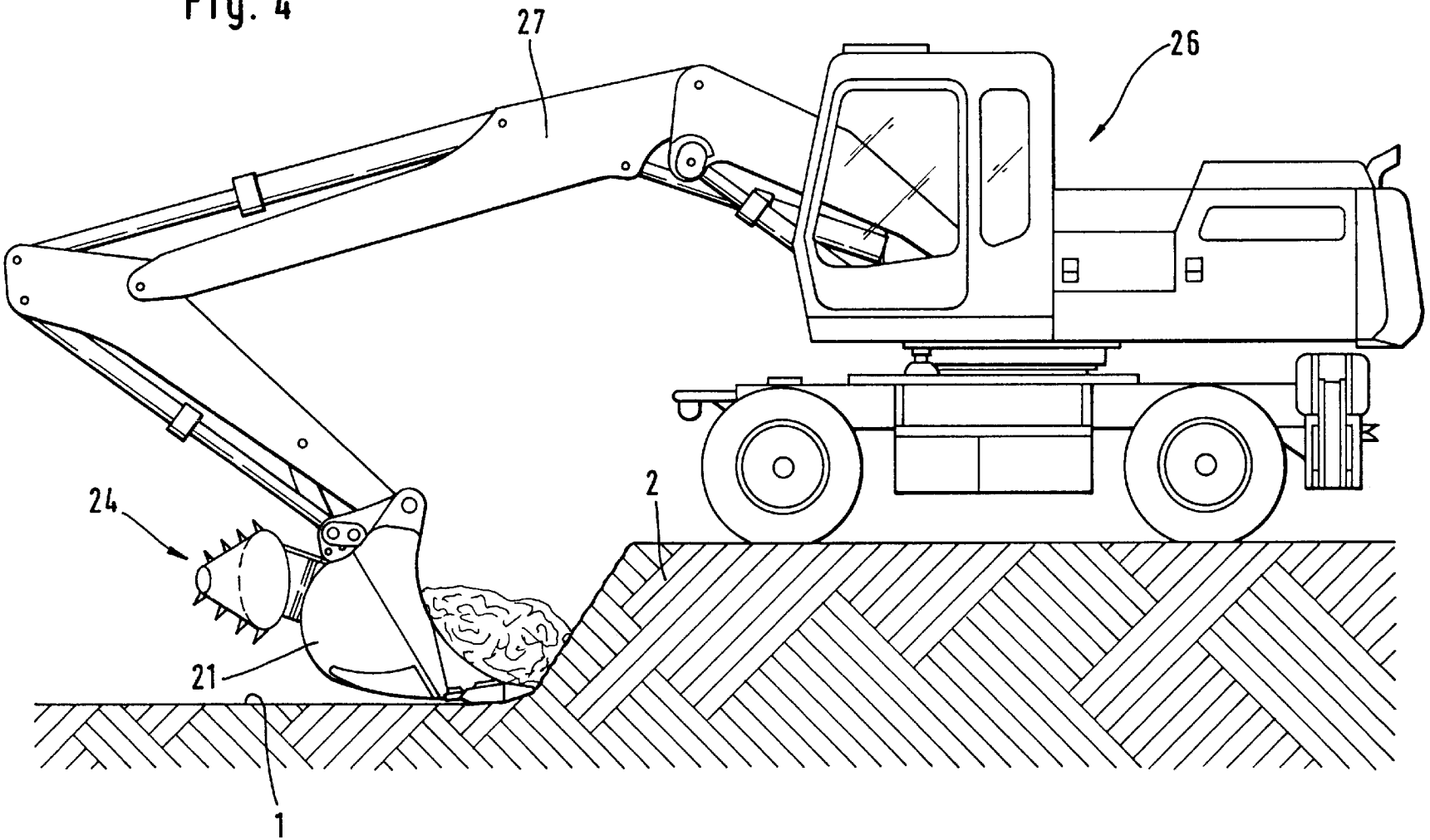
FIG. 4 shows an excavator according to FIG. 3 during excavation with the excavator shovel.

As represented in FIG. 4, the removal of the soil loosened by the milling device 24 is carried out by the excavator shovel 21 which receives the loosened soil. By lifting the arm 27 and laterally pivoting the arm 27 to a position external to the ditch 1, the soil can be deposited to form a heap or filled into a truck for transport away from the work site.

Figure 5:
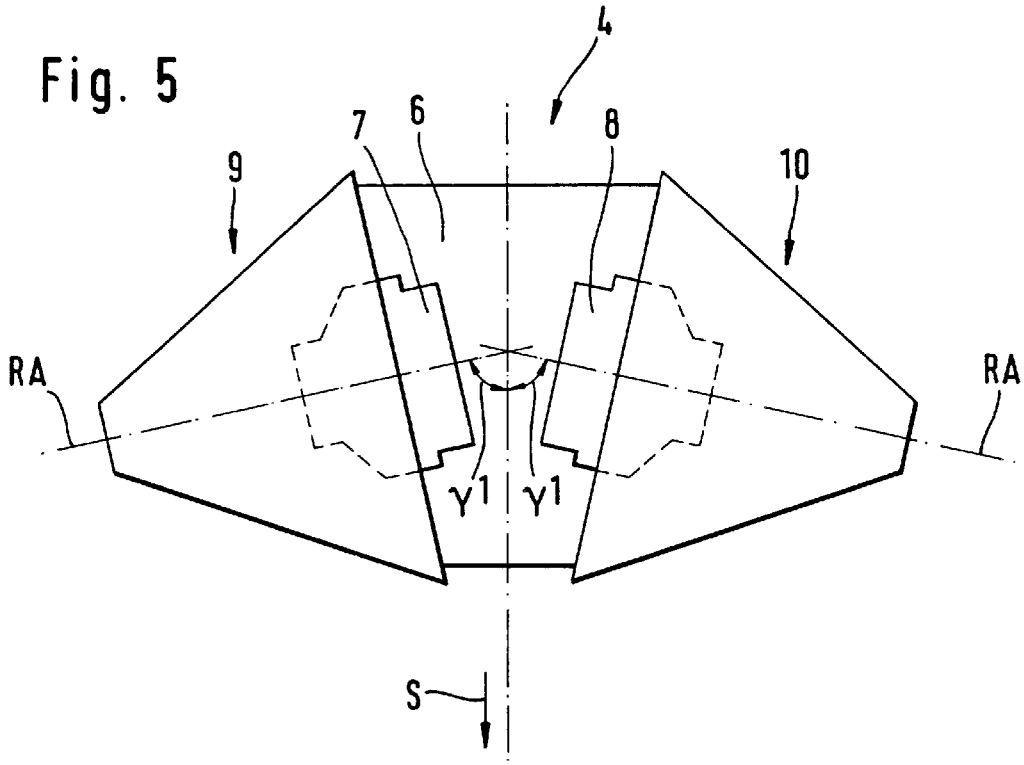
FIG. 5 shows a plan view onto the milling device in which the rotational axes of the milling tools, relative to the longitudinal advancing direction within the ditch, has an angle of less than 90°.

FIG. 5 shows a plan view of the milling device 4 with two milling tools 9 and 10 which, as is shown in FIG. 1, are provided with hydraulic motors 7, 8 and are arranged on a support 6. The longitudinal advancing direction in the ditch is indicated with reference numeral S so that it is clear from the drawing FIG. 5 that a vertical top view is shown. The rotational axis (RA) of the two milling tools 9, 10 have an angle $\gamma$ 1 smaller than 90° relative to the longitudinal advancing direction (working direction) S in the ditch 1. Thus, a wedge shape is formed in the working direction S which results in force vectors relative to the center of the support 6 so that a self-centering action and directional stability result.

Figure 6:
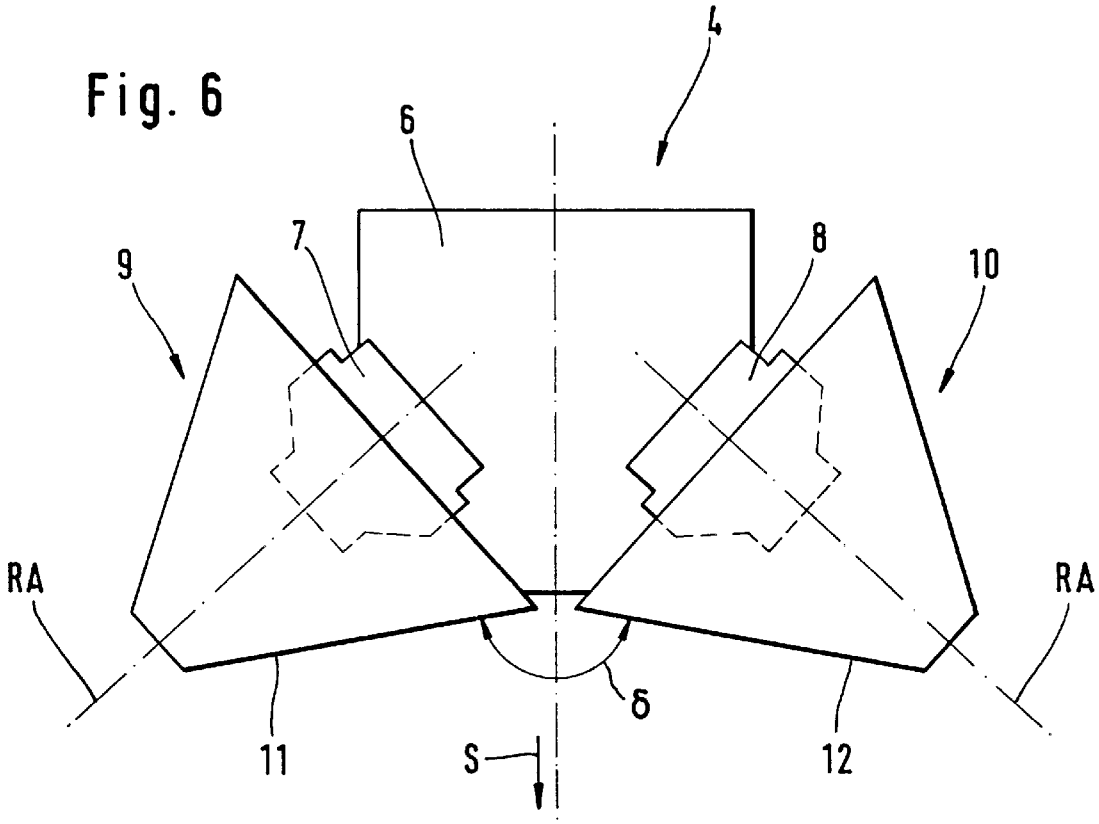
FIG. 6 shows a plan view onto the milling device in which the mantle surface of the milling tools in the longitudinal advancing direction within the ditch has an angle of less than 180°.

A similar effect results from the arrangement according to FIG. 6 which also shows a plan view of the milling device 4. The axis of rotation (RA) of the milling tools 9, 10 are angled relative to the advancing direction (working direction S such that the mantle surfaces 11, 12 of the milling tools 9, 10 at their side facing in the working direction S have an angle $\delta$ which is approximately 160° in the shown embodiment. This angle $\delta$ should be expediently in the range between 150°–160°.

The specification incorporates by reference the disclosure of German priority document DE 197 54 399.5 of Dec. 9, 1997.

The present invention is, of course, in no way restricted to the specific disclosure of the specification and drawings, but also encompasses any modifications within the scope of the appended claims.

What is claimed is:

1. An excavating device comprising:

conical milling tools (9, 10) each having a longitudinal center axis (RA);

at least one motor (7, 8) rotatingly driving said milling tools (9, 10) about said longitudinal center axis (RA);

said milling tools (9, 10) each having a mantle surface (11, 12);

said mantle surfaces (11, 12) positioned at one circumferential point adjacent to one another at a minimum spacing defining a working play (15) between said milling tools (9, 10) such that said mantle surfaces (11, 12) form a continuous working plane (AE);

said longitudinal center axes (RA) of said milling tool (9, 10) angularly ($\gamma$) positioned relative to one another and to a vertical axis (VA) extending between said milling tools (9, 10);

each one of said longitudinal center axes (RA) positioned at an angle of between 50° and 70° to said vertical axis (VA);

each one of said longitudinal center axes (RA) positioned at an angle (α) of <90° relative to an advancing direction of said excavating device.

2. An excavating device according to claim 1, further comprising a support (6), wherein said at least one motor (7, 8) and said milling tools (9, 10) are connected to said support (6) and wherein said support (6), said at least one motor (7, 8) and said milling tools (9, 10) define an attachment unit to be attached to an excavator shovel (21).

3. An excavating device according to claim 1, further comprising an excavator shovel (21) having a backside (22), wherein said at least one motor (7, 8) and said milling tools (9, 10) are fastened to said backside of said excavator shovel (21).

4. An excavating device according to claim 1, wherein said working plane (AE) is positioned at a bottom side of said excavating device and faces the ground (3) to be excavated.

5. An excavating device according to claim 1, wherein said longitudinal center axes (RA) are positioned at an angle of 60° to said vertical axis (VA).

6. An excavating device according to claim 1, wherein said angles of said longitudinal axes (RA) to said vertical axis (VA) are identical.

7. An excavating device according to claim 6, wherein said mantle surfaces (11, 12) at a side facing in said advancing direction are positioned at an angle (δ) of <180° to one another.

8. An excavating device according to claim 7, wherein said angle (δ) is between 150° and 160°.

9. An excavating device according to claim 1, wherein said at least one motor (7, 8) is a hydraulic motor.

10. An excavating device according to claim 9, wherein each one of said milling tools (9, 10) is driven by a separate one of said hydraulic motors (7, 8).

11. An excavating device according to claim 10, wherein said hydraulic motors (7, 8) each have a shaft and wherein said milling tools (9, 10) are directly placed onto said shafts.

12. An excavating device according to claim 10, wherein each one of said milling tools (9, 10) has a cone base (13, 14) and wherein said cone base (13, 14) has a recess (16, 17) in which said hydraulic motors (7, 8) are at least partly received.

* * * * *